US007986084B2

(12) United States Patent
Wei et al.

(10) Patent No.: US 7,986,084 B2
(45) Date of Patent: Jul. 26, 2011

(54) FIELD EMISSION LAMP

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/765,602

(22) Filed: Apr. 22, 2010

(65) Prior Publication Data

US 2010/0201252 A1 Aug. 12, 2010

Related U.S. Application Data

(62) Division of application No. 11/951,160, filed on Dec. 5, 2007, now Pat. No. 7,780,495.

(30) Foreign Application Priority Data

Dec. 27, 2006 (CN) ..... 2006 1 0157770

(51) Int. Cl.
*H01J 63/04* (2006.01)

(52) U.S. Cl. ..... 313/496

(58) Field of Classification Search ..... 445/50–51, 445/23–25; 313/495–496
See application file for complete search history.

(56) References Cited

U.S. PATENT DOCUMENTS 6,873,095 B1 3/2005 Kjellman et al.

FOREIGN PATENT DOCUMENTS

| | | |
|---|---|---|
| JP | H01-266865 | 10/1989 |
| JP | 2000-26760 | 1/2000 |
| JP | 2003-506824 | 2/2003 |
| JP | 2004-319312 | 11/2004 |
| JP | 2006-173016 | 6/2006 |
| JP | 2006-272876 | 10/2006 |

OTHER PUBLICATIONS

Croci et al. (Microelectronics Journal, 35 (2004) pp. 329-336).*

* cited by examiner

*Primary Examiner* — Joseph L Williams
*Assistant Examiner* — Brenitra M Lee
(74) *Attorney, Agent, or Firm* — D. Austin Bonderer

(57) ABSTRACT

A field emission lamp includes a transparent glass tube, a cathode, and an anode. The anode and cathode are both disposed in the transparent glass tube. The cathode includes an electron emission layer. The anode includes a carbon nanotube transparent conductive film located on an inner wall of the transparent glass tube and a fluorescent layer located on the carbon nanotube transparent conductive film.

14 Claims, 3 Drawing Sheets

FIELD EMISSION LAMP

CROSS-REFERENCE TO RELATED APPLICATIONS

This application claims all benefits accruing under 35 U.S.C. §119 from China Patent Application No. 200610157770.2, filed on Dec. 27, 2006 in the China Intellectual Property Office. This application is related to commonly-assigned application entitled, "METHOD FOR MAKING FIELD EMISSION LAMP", filed Dec. 5, 2007 Ser. No. 11/951,163. This application is a division of U.S. patent application Ser. No. 11/951,160, filed on Dec. 5, 2007, entitled, "FIELD EMISSION LAMP AND METHOD FOR MAKING THE SAME".

BACKGROUND

1. Technical Field

The present invention relates to lamps and methods for fabricating the same and, particularly, to a field emission lamp and a method for fabricating the same.

2. Description of Related Art

Fluorescent lamps are virtual necessities in modern daily living. A typical conventional fluorescent lamp generally includes a transparent glass tube. The transparent glass tube has a white or colored fluorescent material coated on an inner surface thereof and a certain amount of mercury vapor filled therein. In use, electrons are accelerated by an electric field and the accelerated electrons collide with the mercury vapor. This collision causes excitation of the mercury vapor and this excitation causes radiation of ultraviolet rays. The ultraviolet rays are absorbed by the fluorescent material and the fluorescent material emits visible light. Compared with the incandescent lamps, the fluorescent lamps have relatively high electrical energy utilization ratios. However, if or when the glass tube is broken, the mercury vapor may leak out therefrom and, because mercury is harmful to humans, mercury filled lamps can be considered as environmentally unsafe.

To address the above problems, a kind of fluorescent lamp without mercury vapor (i.e., field emission lamp) has been developed. A conventional field emission lamp, that is, a fluorescent lamp without the mercury vapor, generally includes a cathode and an anode. The cathode has a number of nanotubes formed on a surface thereof, and the anode has a fluorescent layer facing the nanotube layer of the cathode. In use, a strong electrical field is provided to excite the nanotubes. A certain amount of electrons are emitted and then accelerated from the nanotubes. Such collide with the fluorescent layer of the anode, and thereby, produce visible light. Therefore, the field emission lamp has relatively high efficiency and without being noxious to humans and the environment.

Conventionally, a transparent conductive layer (i.e. transparent conductive material) is disposed under the fluorescent layer of the field emission lamp. The electrical field can be formed between the transparent conductive layer and the emitters (i.e. nanotubes) of the cathode. The visible light produced by the fluorescent layer penetrates through the transparent conductive layer and is emitted from the lamp. Therefore, electrical conductivity and transparency are two essential properties of the transparent conductive layer used in the cold cathode field emission lamps. In prior art, a preferred material of the transparent conductive layer is indium tin oxide (ITO). The ITO can be evaporated and deposited by an industrialized method of magnetron sputtering. Though the method described above can be used in mass production, the costs of raw material and production are high.

What is needed, therefore, is to provide a field emission lamp and a method for fabricating the same, in which the transparent conductive layer has better conductivity and transparency, and the manufacture method thereof is simple, efficient, and low-cost.

BRIEF DESCRIPTION OF THE DRAWINGS

Many aspects of the present field emission lamp and the related method for fabricating the same can be better understood with reference to the following drawings. The components in the drawings are not necessarily to scale, the emphasis instead being placed upon clearly illustrating the principles of the present field emission lamp and the related method for fabricating the same.

Figure 1:
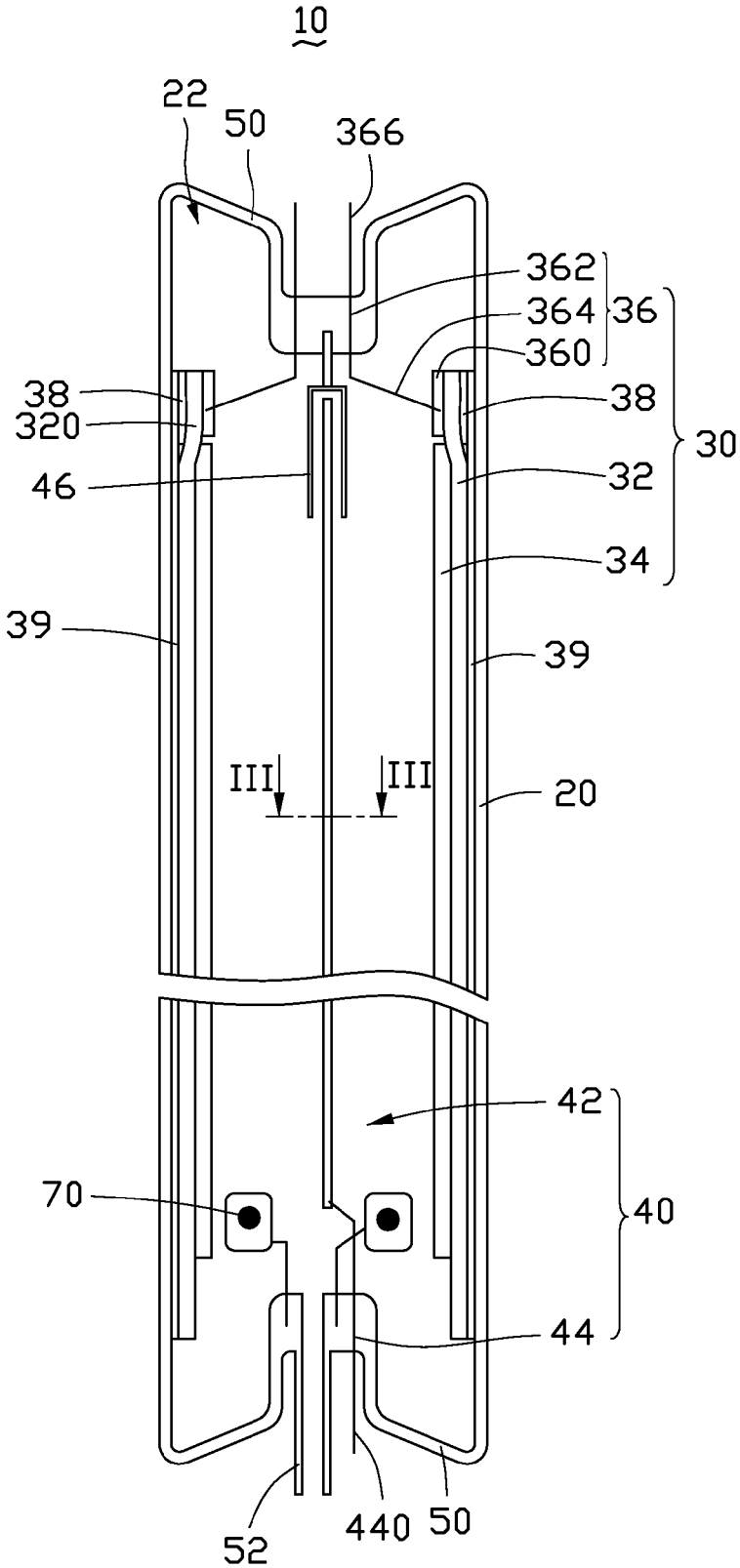
FIG. 1 is a schematic view of a field emission lamp, in accordance with a present embodiment.

Corresponding reference characters indicate corresponding parts throughout the several views. The exemplifications set out herein illustrate at least one preferred embodiment of the present field emission lamp and the related method for fabricating the same, in at least one form, and such exemplifications are not to be construed as limiting the scope of the invention in any manner.

DETAILED DESCRIPTION

Reference will now be made to the drawings to describe, in detail, embodiments of the present field emission lamp and the related method for fabricating the same.

Referring to FIG. 1, a field emission lamp 10 in the present embodiment includes a transparent glass tube 20, an anode 30, a cathode 40, a first feedthrough 50, and a second feedthrough 50'. The anode 30 and cathode 40 are both disposed in the transparent glass tube 20.

The glass tube 20 includes two open ends 22. The first feedthrough 50 and the second feedthrough 50' seal the two open ends 22 respectively, and, thereby, form a hermetic space in the glass tube 20. The first feedthrough 50 includes an pumping stem 52. The pumping stem 52 connects the hermetic space to the outside. A vacuum pump (not shown in FIG. 1) can be connected to the pumping stem 52 to evacuate the air in the hermetic space. The pumping stem 52 is sealed after the process of evacuation. The feedthroughs 50, 50' can, beneficially, be made of glass or other materials. In one useful embodiment, the feedthroughs 50, 50' are made of glass. Quite suitably, the feedthroughs 50, 50' are glass stems.

The anode 30 includes a carbon nanotube transparent conductive film 32, a fluorescent layer 34, and an anode electrode 36. The carbon nanotube transparent conductive film 32 is formed on an inner wall of the glass tube 20. The fluorescent layer 34 is formed on the carbon nanotube transparent conductive film 32. The fluorescent layer 34 covers the carbon nanotube transparent conductive film 32 except for an uncovered area 320 close to the anode electrode 36.

The carbon nanotube transparent conductive film 32 includes a plurality of carbon nanotubes. In one embodiment, a length of the carbon nanotubes is usefully in the approximate range of 1 to 100 microns. Quite suitably, the length of the carbon nanotubes is about 10 microns, and the diameter of the carbon nanotubes is in the approximate range of 1 to 100 nanometers. The fluorescent layer 34 is made of material with high efficiency, requiring only a low applied voltage, but providing high luminance. In one suitable embodiment, the material of the fluorescent layer 34 can be selected from a group consisting of white and colored fluorescent materials. Therefore, the field emission lamp 10 can emit white or colored light in use.

The anode electrode 36 includes a lead pad 360, a lead rod 362, and a lead wire 364 connecting the lead pad 360 to the lead rod 362. The lead pad 360 is disposed on the uncovered area 320 of the carbon nanotube transparent conductive film 32. The lead rod 362 is fastened on the second feedthrough 50' and extends to the outside as an external electrode 366 for electrically connecting with an external power supply.

Quite suitably, a colloidal graphite layer 38 is disposed under the uncovered area 320. When lead pad 360 is disposed on the uncovered area 320 of the carbon nanotube transparent conductive film 32, the carbon nanotube transparent conductive film 32 may be destroyed around the area of the lead pad 360. Therefore, the colloidal graphite layer 38 can connect to the lead pad 360 and provide an electrical connection between the carbon nanotube transparent conductive film 32 and the anode electrode 36.

The anode electrode 36 is used to provide an electrical connection between the anode 30 and the external power supply and may be replaced by other connection means. In one embodiment, the anode electrode 36 may only include the lead rod 362 or the lead wire 364 to electrically connect the carbon nanotube transparent conductive film 32 to the external power supply directly. In another embodiment, the anode electrode 36 can include a lead pad 360 and a lead rod 362 (or a lead wire 364). The lead pad 360 connects to the carbon nanotube transparent conductive film 32. The lead rod 362 (or the lead wire 364) connects the lead pad 360 to the external power supply.

Figure 2:
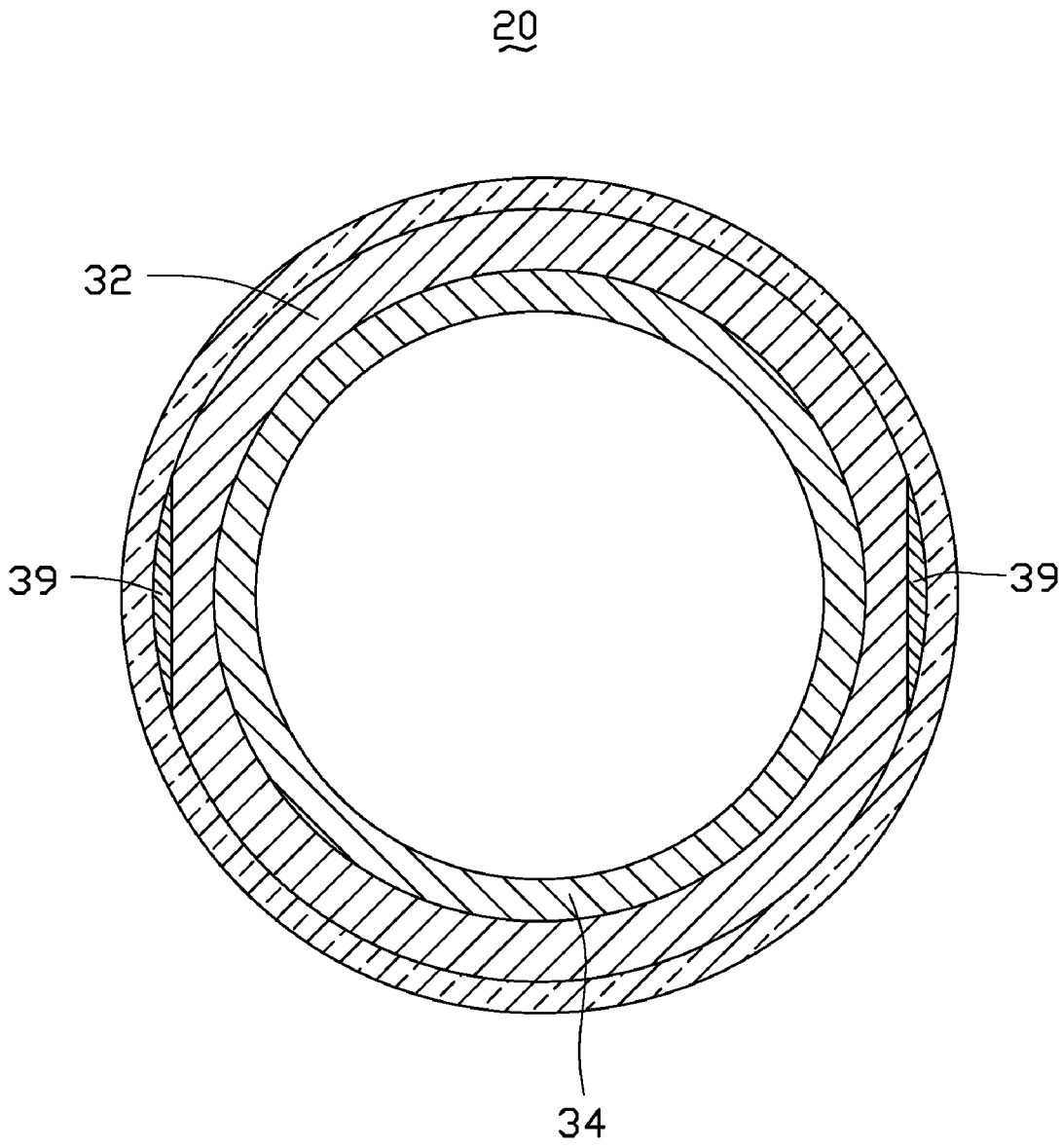
FIG. 2 is an axial cross-section view of a glass tube of the field emission lamp of FIG. 1.

Referring to FIG. 2, the anode 30 can further include at least one conductive wire 39 disposed between the inner wall of the glass tube 20 and the carbon nanotube transparent conductive film 32, or between the carbon nanotube transparent conductive film 32 and the fluorescent layer 34. An end of the conductive wire 39 is connected to the anode electrode 36 through the uncovered area 320 of the carbon nanotube transparent conductive film 32. In the present embodiment, more than one conductive wire 39 is disposed separately and parallel to an axis of the glass tube 20. The conductive wire 39 can, beneficially, be a silver wire or an indium tin oxide (ITO) wire. Quite usefully, a width of the conductive wire 39 is in the approximate range of 10 to 1000 microns.

The cathode 40 is accommodated in the glass tube 20 and includes a cathode emitter 42 and a cathode electrode 44. In the present embodiment, the cathode emitter 42 is in a cylindrical shape or a filamentary shape. Referring to FIG. 1, one end of the cathode emitter 42 is fastened to the second feedthrough 50' through a nickel tube 46 and the other end thereof is fastened to the cathode electrode 44. The cathode electrode 44 extends to outside of the glass tube 20 so as to be used as another external electrode 440 capable of being connected to the external power supply.

Quite usefully, the cathode 40 can further include a spring (not shown) to connect the cathode emitter 42 to the cathode electrode 44. As such, when the temperature of the cathode emitter 42 changes as the external power supply is turned on or off, stress caused by expansion or contraction of the cathode emitter 42 can be eliminated by the spring.

The cathode electrode 44 provides an electrical connection between the cathode emitter 42 and the external power supply and may be replaced by other connection means. In one embodiment, the cathode emitter 42 can directly extend from the feedthrough 50 and connect to the external power supply.

Figure 3:
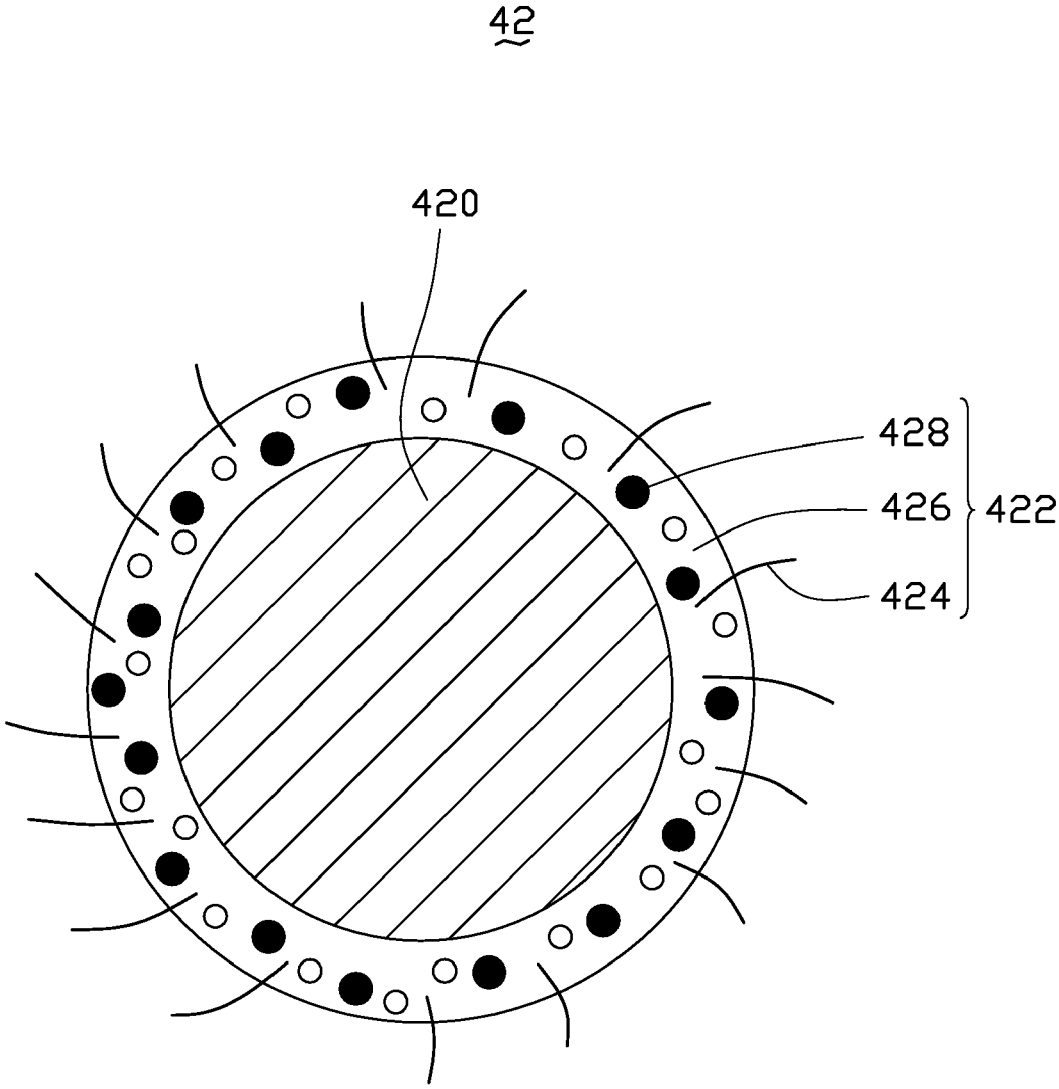
FIG. 3 is an enlarged cross-section view along a line III-III of FIG. 1.

Referring to FIG. 3, the cathode emitter 42 includes a conductive member 420 and an electron emission layer 422 formed on the conductive member 420. Quite suitably, a diameter of the conductive member 420 is in the approximate range from 0.1 to 2 millimeters. The material of the conductive member 420 can, beneficially, be any kind of conductive metal or metal alloy. In one useful embodiment, the conductive member 420 is made of nickel (Ni). The electron emission layer consists of glass 426, a plurality of carbon nanotubes 424 and a plurality of conductive particles 428 dispersed in the glass 426. A length of the carbon nanotubes is in the approximate range from 1 to 100 microns, and a diameter thereof is in the approximate range from 1 to 100 nanometers.

The field emission lamp 10 can further include at least one inspiratory device 70. In the present embodiment, two inspiratory devices 70 are disposed on the first feedthrough 50. In use, the getters in the inspiratory devices 70 can consume the residual gas in the glass tube 20 and the gas discharged from the fluorescent layer 34.

During the working of the field emission lamp 10, a predetermined electric field can be applied between the carbon nanotube transparent conductive film 32 of the anode 30 and the electron emission layer 422 of the cathode 40. The carbon nanotubes 424 can emit electrons in the electric field. When the emitted electrons collide against the fluorescent layer 34, a visible light can be produced. Additionally, the conductive wire 39 can effectively reduce the potential differences between different areas of the carbon nanotube transparent conductive film 32 to provide a uniform light emission of the field emission lamp 10.

A method for fabricating the above-described field emission lamp 10 includes the steps of: (a) providing a transparent glass tube 20, including at least one conductive wire 39, a carbon nanotube transparent conductive film 32, and a fluorescent layer 34 formed on an inner wall thereof; and (b) providing an anode electrode 36, a cathode electrode 44, a cathode emitter 42 sealed by the feedthroughs 50 and 50' in the glass tube 20 to achieve the field emission lamp 10.

The step (a) can further include the substeps of: (a1) coating at least one line of conductive slurry on the inner wall of the glass tube 20, and drying the line to form the conductive wire 39; (a2) annealing the glass tube 20 in an atmosphere of N2 and/or another inert gas; (a3) forming a layer of carbon nanotube paste on the inner wall of the glass tube 20 formed with the conductive wire 39, and drying the carbon nanotube paste; (a4) forming the fluorescent layer 34 on the dried carbon nanotube paste; and (a5) baking the glass tube 20 with the carbon nanotube paste layer and the fluorescent layer at about 320° C. for about 20 minutes in an atmosphere of N2 and/or another inert gas, and cooling down the glass tube 20 to room temperature.

In step (a1), a width of the line is in the approximate range of 10 to 1000 microns. The conductive slurry can be formed by the substeps of: (a11) providing an amount of organic carrier, a plurality of conductive particles, and a plurality of glass particles; and (a12) dispersing the conductive particles and the glass particles in the organic carrier to form the conductive slurry. The conductive slurry can be sonicated (i.e., subjected to ultrasound) for, e.g., about 3 to 5 hours at about 60° C. to 80° C. and centrifugalized to uniformly disperse/mix the conductive particles in the organic carrier.

The material of conductive particles can, beneficially, include metal particles (e.g. silver) and indium tin oxide (ITO) particles. The conductive particles can, advantageously, be further milled before the mixing/dispersing step. A diameter of the conductive particles can, beneficially, be in the approximate range of 0.05 to 2 microns. The organic carrier can, mainly, include terpineol as a solvent, dibutyl phthalate as a plasticizer, and ethyl-cellulose as a stabilizer.

In one embodiment, a colloidal graphite layer 38 can be usefully disposed on the glass tube 20 after the step (a1).

The step (a2) can further include the substeps of: (a21) disposing the glass tube 20 in an oven with an atmosphere of N2 and/or another inert gas; (a22) heating the glass tube 20 at a temperature of about 320° C. for about 10 minutes; (a23) heating the glass tube 20 at a temperature of about 430° C. for about 30 minutes; and (a24) cooling the glass tube 20 down to room temperature. The organic carrier can, substantially, be removed by this step.

In step (a3), the layer of the carbon nanotube paste can, suitably, be formed by the substeps of: (a31) vertically arranging the glass tube 20, and sealing the lower end of the glass tube 20; (a32) providing a carbon nanotube paste, and filling the glass tube 20 through the upper end with the carbon nanotube paste; and (a33) unsealing the lower end of the glass tube 20.

In step (a33), the carbon nanotube paste flows down under force of gravity. The carbon nanotube paste is, partially, adsorbed by the inner wall of the glass tube 20 to form the layer of carbon nanotube paste. Quite suitably, the layer of carbon nanotube paste can be formed in a clean surrounding. In one useful embodiment, the dust density of the surrounding is less than about 1000 mg/m$^3$.

In step (a32), the carbon nanotube paste can, usefully, be fabricated by the substeps of: (I) providing an organic carrier; (II) dispersing the carbon nanotubes in ethylene dichloride in a crusher to form a carbon nanotube solution, and ultrasonically agitating the solution to promote the dispersion of the carbon nanotubes therein; (III) filtrating the carbon nanotube solution; (IV) ultrasonically mixing the carbon nanotube solution with the organic carrier; and (V) vaporizing the mixture of the carbon nanotube solution and the organic carrier in water bath to achieve the carbon nanotube paste in a predetermined concentration.

In step (I), the organic carrier can, mainly, include terpineol as a solvent, dibutyl phthalate as a plasticizer, and ethyl-cellulose as a stabilizer. The method for forming the organic carrier includes the steps of: dissolving the ethyl-cellulose into the terpineol by stirring thereof in oil bath, and filling the dibutyl phthalate into the mixture of the ethyl-cellulose and the terpineol in the same condition. In a suitable embodiment, the organic carrier contains about 90% terpineol, 5% dibutyl phthalate, and 5% ethyl-cellulose. The temperature of oil bathing is in the approximate range from 80° C. to 100° C. Quite suitably, in the present embodiment, the temperature is 100° C. The stirring time is in the approximate range from 10 to 25 hours. Quite usefully, in the present embodiment, the stirring time is 24 hours.

In step (II), the carbon nanotubes can, advantageously, be formed by an arc discharge method, a laser ablation method, or a chemical vapor deposition (CVD) method. In one useful embodiment, the length of the carbon nanotubes is in the range from 1 to 100 microns, and the diameter thereof is in the range from 1 to 100 nanometers. The carbon nanotubes can, beneficially, be about 2 grams in every 500 milliliters ethylene dichloride. Quite suitably, in the crusher, the dispersing time is in the approximate range from 5 to 30 minutes. Rather appropriately, the crushing time, in this embodiment, is about 20 minutes. The ultrasonic agitating time is in the approximate range from 10 to 40 minutes. Preferably, the ultrasonically agitating time is about 30 minutes.

In step (III), the carbon nanotube solution can be filtrated by a screen, and quite usefully, be filtrated by a 400-mesh screen. In step (IV), the amount of the carbon nanotubes and the organic carrier is in the ratio of about 1:15. The time of ultrasonically mixing is about 30 minutes.

In step (V), quite suitably, when about 2 grams of carbon nanotubes and about 500 milliliters of ethylene dichloride are mixed with organic carrier in the ratio of 1:15, after the evaporation, the carbon nanotube paste is 200 milliliters. The temperature of water bath is about 90° C.

The transparency and conductivity of the carbon nanotube transparent conductive film relate to the concentration of the carbon nanotubes in carbon nanotube paste. A higher concentration can result in higher conductivity but lower transparency (and vice versa).

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission lamp comprising:

a transparent glass tube comprising an inner wall;

a cathode disposed in the transparent glass tube comprising an electron emission layer; and an anode disposed in the transparent glass tube comprising:

a carbon nanotube transparent conductive film located on the inner wall of the transparent glass tube, a fluorescent layer located on the carbon nanotube transparent conductive film, and an anode electrode, the anode electrode comprises a lead pad, a lead rod, and a lead wire connected to the lead pad and to the lead rod, the lead pad is disposed on the carbon nanotube transparent conductive film.

2. The field emission lamp of claim 1, further comprising at least one conductive wire that extends parallel to an axis of the transparent glass tube.

3. The field emission lamp of claim 2, wherein the at least one conductive wire is disposed between the carbon nanotube transparent conductive film and the fluorescent layer.

4. The field emission lamp of claim 2, wherein the at least one conductive wire is disposed between the inner wall of the transparent glass tube and the carbon nanotube transparent conductive film.

5. The field emission lamp of claim 2, wherein a width of the at least one conductive wire is in an approximate range of 10 to 1000 microns.

6. The field emission lamp of claim 2, wherein the at least one conductive wire is an indium tin oxide wire.

7. The field emission lamp of claim 2, wherein the at least one conductive wire is an argentum wire.

8. The field emission lamp of claim 1 further comprising a first feedthrough and a second feedthrough, wherein the transparent glass tube comprises two open ends, the first feedthrough and the second feedthrough seal the two open ends respectively to define a hermetic space in the transparent glass tube.

9. The field emission lamp of claim 8, wherein the first feedthrough comprises a pumping stem, the pumping stem connects the hermetic space to outside the transparent glass tube.

10. The field emission lamp of claim 8 further comprising at least one inspiratory device disposed on the first feedthrough.

11. The field emission lamp of claim 1, wherein the cathode comprises a cathode emitter and a cathode electrode.

12. The field emission lamp of claim 11, wherein the cathode emitter has a cylindrical shape or a filamentary shape.

13. The field emission lamp of claim 11, wherein the cathode emitter comprises a conductive member and an electron emission layer located on the conductive member.

14. The field emission lamp of claim 13, wherein the electron emission layer comprises glass, a plurality of carbon nanotubes, and a plurality of conductive particles dispersed in the glass.

* * * * *